United States Patent [19]

Olson

[11] 4,438,601

[45] Mar. 27, 1984

[54] SANDPAPER CLEANING DEVICE

[76] Inventor: Alvin O. Olson, 546-9th St., SE., Mason City, Iowa 50401

[21] Appl. No.: 473,679

[22] Filed: Mar. 9, 1983

Related U.S. Application Data

[63] Continuation of Ser. No. 251,353, Apr. 6, 1981, abandoned.

[51] Int. Cl.[3] ..... B24B 55/00

[52] U.S. Cl. ..... 51/262 A; 15/27; 15/41 R; 15/388

[58] Field of Search ..... 51/262 A, 74 R, 80 A; 15/23, 27, 41 R, 374, 384, 388

[56] References Cited

U.S. PATENT DOCUMENTS

| | | | |
|---|---|---|---|
| 1,081,209 | 12/1913 | Carr | 15/374 X |
| 1,890,147 | 12/1932 | Cotti | 15/27 X |
| 1,927,476 | 9/1933 | Walker et al. | 51/58 |
| 2,098,506 | 11/1937 | McLaughlin et al. | 51/78 |
| 2,222,909 | 11/1940 | Lo Cascio | 15/27 X |
| 2,396,861 | 3/1946 | Linderoth | 15/41 R |
| 2,403,105 | 7/1946 | Linderoth | 15/41 R |
| 2,968,055 | 1/1961 | Linderoth | 15/27 X |
| 3,159,860 | 12/1964 | Colver | 15/41 R |
| 3,319,278 | 5/1967 | Frazer | 15/41 R |
| 3,594,841 | 7/1971 | Kieves | 15/41 R X |
| 4,293,970 | 10/1981 | Bencene et al. | 51/262 A X |

FOREIGN PATENT DOCUMENTS

| | | | |
|---|---|---|---|
| 495133 | 8/1953 | Canada | 51/262 A |
| 63528 | 7/1892 | Fed. Rep. of Germany | 51/27 |
| 136103 | 10/1929 | Fed. Rep. of Germany | 51/74 R |

*Primary Examiner*—Frederick R. Schmidt
*Assistant Examiner*—Robert P. Olszewski
*Attorney, Agent, or Firm*—Zarley, McKee, Thomte, Voorhees & Sease

[57] ABSTRACT

A sandpaper cleaning tool is disclosed comprising an elongated horizontal handle. First and second U-shaped brackets are secured to one surface of the handle and are axially offset with respect to each other and with the longitudinal axis of the handle. Cylindrical wire brushes are freely rotatably mounted on each of the brackets. The method comprises moving the tool under pressure longitudinally over sandpaper to be cleaned, thus causing the axially offset brushes to rotate and skid to clean the sandpaper.

2 Claims, 7 Drawing Figures

SANDPAPER CLEANING DEVICE

This is a continuation of application Ser. No. 251,353, filed Apr. 6, 1981 now abandoned.

BACKGROUND OF THE INVENTION

Sandpaper is an important product used in many industries, particularly in auto body repair work, as well as woodworking shops. Useful sandpaper often has its useful life shortened as the pores or spaces present in its working surface become filled with debris. Special tools for cleaning debris from the pores of the sandpaper are not available. Cleaning with conventional brushes is cumbersome and time consuming.

SUMMARY OF THE INVENTION

A sandpaper cleaning tool is disclosed comprising an elongated horizontal handle. First and second U-shaped brackets are secured to one surface of the handle and are axially offset with respect to each other and with the longitudinal axis of the handle. Cylindrical wire brushes are freely rotatably mounted on each of the brackets. The method comprises moving the tool under pressure longitudinally over sandpaper to be cleaned, thus causing the axially offset brushes to rotate and skid to clean the sandpaper.

In use, the tool is moved longitudinally over the sandpaper. The offset brushes rotate, and their eccentric positions churn and dig the debris out of the pore areas.

It is therefore the principal object of the invention to provide a method and means for cleaning sandpaper which can quickly and efficiently clean debris from the sandpaper pore areas.

A further object of this invention is to provide a means for cleaning sandpaper which is economical of manufacture and durable in use.

These and other objects will be apparent to those skilled in the art.

DESCRIPTION OF THE PREFERRED EMBODIMENT

Figure 1:
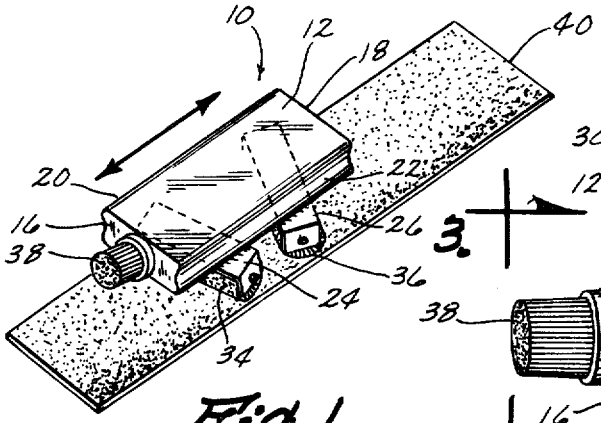
FIG. 1 is a perspective view of the device of this invention in use on a sandpaper strip.
Figure 2:
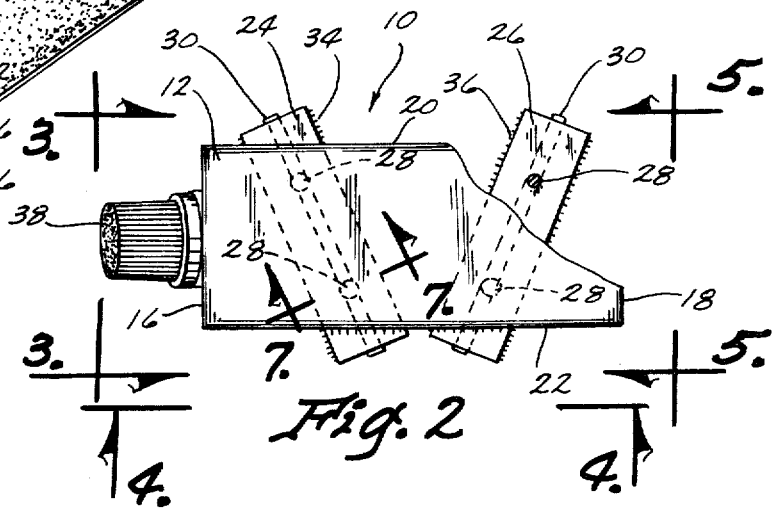
FIG. 2 is a partial plan view thereof taken at an enlarged scale.

The numeral 10 designates a rectangular block handle having top and bottom surfaces 12 and 14, opposite ends 16 and 18, and opposite sides 20 and 22.

U-shaped brackets 24 and 26 are secured by screws 28 to the bottom surface 14 of handle 10. The longitudinal axes of brackets 24 are offset with respect to each other as well as with respect to the longitudinal axis of handle 10. The angle between the longitudinal axis of each bracket and the longitudinal axis of the handle is preferably in the order of 8°.

Figure 3:
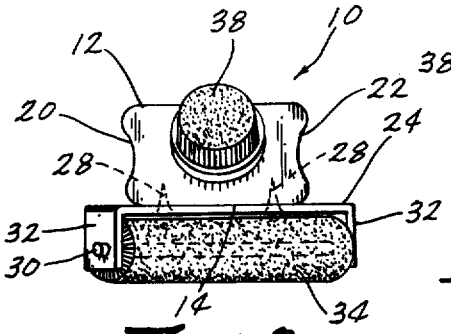
FIG. 3 is an end view thereof taken on line 3—3 of FIG. 2.
Figure 4:
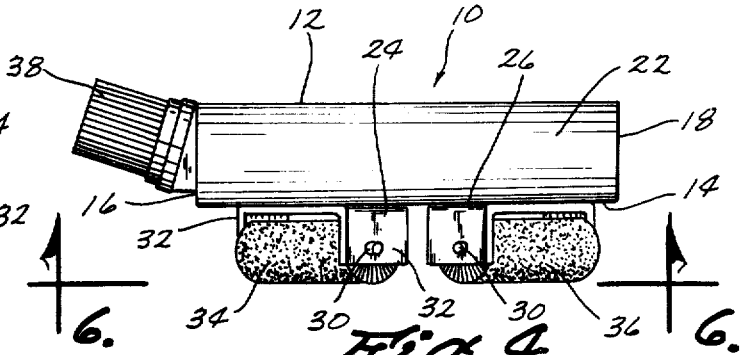
FIG. 4 is a side elevational view thereof taken on line 4—4 of FIG. 2.
Figure 5:
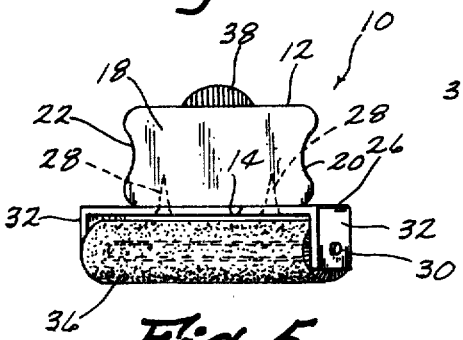
FIG. 5 is an end elevational view thereof taken on line 5—5 of FIG. 2.
Figure 6:
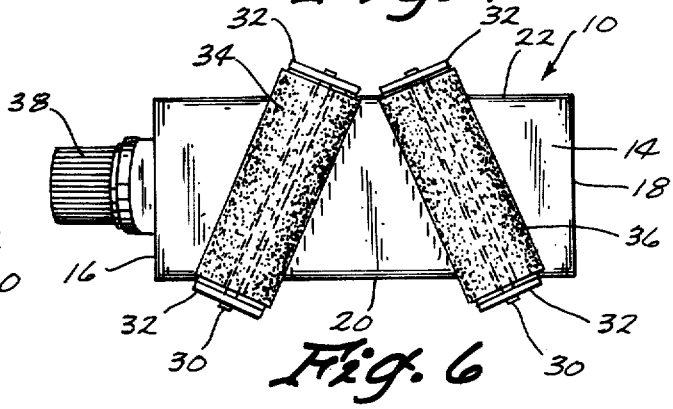
FIG. 6 is a bottom plan view thereof.
Figure 7:
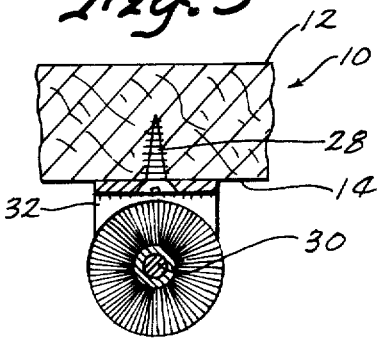
FIG. 7 is a sectional view taken on line 7—7 of FIG. 2.

Shafts 30 extend between ears 32 on each of the brackets 24 and 26. Cylindrical wire brushes 34 and 36 are rotatably mounted on shafts 30. The brushes extend below the brackets as shown in FIGS. 3, 4 and 5.

A soft brush 38 is secured to end 16 of handle 10 to be used to remove debris from the sandpaper which is loosened by brushes 34 and 36.

In operation, a strip of debris-filled sandpaper 40 is placed face-up on a supporting surface. The tool is placed thereon as shown in FIG. 1. Hand pressure is placed thereon, and the handle is reciprocated longitudinally on the sandpaper, causing the wire brushes 34 and 36 to rotate and slide on the surface of the sandpaper. The brushes partially slide or drag on the sandpaper because of their eccentric or angular position on the handle 10. The combined rotation and sliding action of the brushes causes the brush bristles to "dig" the debris from the pores of the sandpaper much more effectively than would be the case if the brushes were merely in parallel rotation to each other.

After the wire brushes have dislodged the debris from the surface of the sandpaper, the brush 38 can be used to "sweep" the debris away.

This tool is effective to clean otherwise useful sandpaper, and permits cleaned sandpaper to be reused, a plurality of times.

It is, therefore, seen that this invention at least accomplishes its stated objectives.

I claim:

1. A cleaning tool for cleaning sandpaper, comprising, an elongated horizontally disposed handle having a horizontal longitudinal axis, opposite parallel side portions, and a horizontally disposed bottom portion, first and second longitudinally spacd apart brackets secured to and spanning said handle adjacent said bottom portion, said brackets being angularly disposed with respect to each other and with respect to said longitudinal axis, and a horizontally disposed cylindrically shaped roller wire brush being parallel to said bottom portion and having a freely rotatable axle mounted on each of said brackets, each of said brackets being of a channel construction including spaced apart parallel ears and an integral connecting web, said parallel ears adapted to receive said roller brush axle, said parallel ears being perpendicular to the longitudinal axis of said brush axle, said brackets and said rollers extending beyond the side portions of said handle, and comprising the only structure on said bottom portion.

2. The cleaning tool of claim 1 wherein said brushes are disposed at an angle of approximately 8° with respect to said longitudinal axis.

* * * * *